US009742124B2

(12) United States Patent
Kusamaki et al.

(10) Patent No.: US 9,742,124 B2
(45) Date of Patent: Aug. 22, 2017

(54) TERMINAL BLOCK

(71) Applicants: TOYOTA JIDOSHA KABUSHIKI KAISHA, Toyota-shi, Aichi-ken (JP); Sumitomo Wiring Systems, Ltd., Yokkaichi, Mie (JP); Autonetworks Technologies, LTD., Yokkaichi, Mie (JP); SUMITOMO ELECTRIC INDUSTRIES, LTD., Itami-shi, Hyogo (JP)

(72) Inventors: Haruki Kusamaki, Okazaki (JP); Hiroyuki Matsuoka, Yokkaichi (JP); Takuya Tate, Yokkaichi (JP); Yoshimi Uchida, Yokkaichi (JP); Junpei Nakamoto, Yokkaichi (JP); Tetsuya Iida, Yokkaichi (JP); Daisuke Hashimoto, Yokkaichi (JP); Kouji Fukumoto, Yokkaichi (JP)

(73) Assignees: TOYOTA JIDOSHA KABUSHIKI KAISHA, Toyota (JP); SUMITOMO WIRING SYSTEMS, LTD., Yokkaichi (JP); AUTONETWORKS TECHNOLOGIES, LTD., Yokkaichi (JP); SUMITOMO ELECTRIC INDUSTRIES, LTD., Itami (JP)

( * ) Notice: Subject to any disclaimer, the term of this patent is extended or adjusted under 35 U.S.C. 154(b) by 0 days.

(21) Appl. No.: 15/117,990

(22) PCT Filed: Feb. 10, 2015

(86) PCT No.: PCT/IB2015/000134

§ 371 (c)(1),
(2) Date: Aug. 10, 2016

(87) PCT Pub. No.: WO2015/121734

PCT Pub. Date: Aug. 20, 2015

(65) Prior Publication Data

US 2016/0380390 A1 Dec. 29, 2016

(30) Foreign Application Priority Data

Feb. 13, 2014 (JP) ..... 2014-025920

(51) Int. Cl.
*H01R 13/6592* (2011.01)
*H01R 9/03* (2006.01)
(Continued)

(52) U.S. Cl.
CPC ..... *H01R 13/6592* (2013.01); *H01R 9/034* (2013.01); *H01R 9/2483* (2013.01);
(Continued)

(58) Field of Classification Search
CPC ..... H01R 13/6592
(Continued)

(56) References Cited

U.S. PATENT DOCUMENTS 5,679,926 A 10/1997 Maloney et al.
5,938,475 A * 8/1999 Penner ..... H01R 9/0527 439/607.44
(Continued)

FOREIGN PATENT DOCUMENTS

JP 2003-264040 A 9/2003
JP 2006-344398 A 12/2006
(Continued)

*Primary Examiner* — Tulsidas C Patel
*Assistant Examiner* — Marcus Harcum
(74) *Attorney, Agent, or Firm* — Oliff PLC

(57) ABSTRACT

A terminal block including an electric wire, a shield material, a terminal, a housing and a shield bracket. The shield material is configured to cover at least a part of the electric wire. The electric wire is connected to the terminal. The housing is configured to accommodate the terminal. The shield bracket is fixed to the housing. The shield bracket is configured to hold the shield material, and includes a folding portion. The folding portion is configured to hold an end of
(Continued)

the shield material by sandwiching the end of the shield material. The folding portion has a notch hole.

2 Claims, 5 Drawing Sheets

(51) Int. Cl.
*H01R 13/6593* (2011.01)
*H01R 9/24* (2006.01)
*H01R 4/18* (2006.01)

(52) U.S. Cl.
CPC ..... *H01R 13/6593* (2013.01); *H01R 4/18* (2013.01); *H01R 2201/26* (2013.01)

(58) Field of Classification Search
USPC ..... 439/607.44, 607.47, 607.41; 174/32
See application file for complete search history.

(56) References Cited

U.S. PATENT DOCUMENTS 6,705,896 B1 * 3/2004 Chang ..... H01R 9/034 439/452
7,344,413 B2 * 3/2008 Nishida ..... H01R 9/032 439/607.41
7,695,320 B2 * 4/2010 Tsukashima ..... H01R 9/032 439/607.44
9,059,534 B2 * 6/2015 Endo ..... H01R 13/5205
9,241,431 B2 * 1/2016 Hashimoto ..... B60R 16/0215
9,318,849 B2 * 4/2016 Kobayashi ..... H01R 13/5205
2001/0045701 A1 * 11/2001 Toal ..... F16J 15/3404 277/370
2002/0192998 A1 * 12/2002 Noro ..... H01R 13/6592 439/497
2003/0221850 A1 * 12/2003 Mizutani ..... H01R 13/6592 174/36
2005/0136738 A1 * 6/2005 Wada ..... H01R 9/032 439/607.43
2008/0113559 A1 5/2008 Hamai et al.
2009/0130903 A1 5/2009 Tsukashima et al.
2013/0056256 A1 * 3/2013 Guillanton ..... H01R 9/0503 174/359
2015/0027772 A1 1/2015 Hashimoto et al.

FOREIGN PATENT DOCUMENTS

JP 2012-135167 A 7/2012
JP 2012-169497 A 9/2012
JP 2013-176279 A 9/2013
WO 2013/077461 A1 5/2013

* cited by examiner

TERMINAL BLOCK

BACKGROUND OF THE INVENTION

1. Field of the Invention

The present invention relates to a terminal block to which an electric wire including a shield material is connected, and particularly, relates to improvement of a structure in which the terminal block holds the shield material.

2. Description of Related Art

Conventionally, an electric wire at least partially covered with a shield material such as a braided wire has been used as a high-voltage line for a vehicle. A technique to connect an end of the electric wire to a terminal block of a device is described in Japanese Patent Application Publication No. 2006-344398 (JP 2006-344398 A) and Japanese Patent Application Publication No. 2012-135167 (JP 2012-135167 A).

JP 2006-344398 A describes a terminal block of an electric apparatus, and the terminal block includes a terminal connected to an electric wire of which an outer circumference is covered with a braided wire, and a housing in which to accommodate the terminal. An end of the braided wire is placed so as to cover an outer peripheral surface of a tubular member fixed to the housing. The end of the braided wire is tightened by a ring-shaped fixing member from its outer peripheral side, so that the braided wire is held by the tubular member.

JP 2012-135167 A describes a structure in which an electric wire covered with a shield portion and configured to connect a motor generator to an inverter in a vehicle is connected to a terminal inside a housing. An end of the shield portion is held by being sandwiched between two members fixed to the housing, that is, an inner cylindrical member and an outer cylindrical member.

In a case where the electric wire with the shield material is connected to the terminal in the conventional technique, the end of the shield material is held by being sandwiched between two members, and at least one of those members is fixed to the housing, as described in the above two patent documents. Thus, two members are used in a holding structure of the shield material. However, it is demanded that the number of components be reduced more than the above structure to improve working efficiency.

From the viewpoint of reducing the number of components, such a structure is considered that one shield bracket fixed to a housing is used as a member used to hold a shield material, and the shield bracket is folded and caulked with an end of the shield material being sandwiched therein, so as to hold the shield material. However, in such a configuration that the shield bracket is just folded, spring back occurs after bending, so that the caulking is loosened. Therefore, the shield material cannot be held surely.

SUMMARY OF THE INVENTION

The present invention provides a terminal block to which an electric wire including a shield material is connected and which is able to surely hold the shield material.

The present invention has the following feature. A terminal block including an electric wire, a shield material, a terminal, a housing and a shield bracket. The shield material is configured to cover at least a part of the electric wire. The electric wire is connected to the terminal. The housing is configured to accommodate the terminal. the shield bracket is fixed to the housing. The shield bracket is configured to hold the shield material, and includes a folding portion. The folding portion is configured to hold an end of the shield material by sandwiching the end of the shield material. The folding portion has a notch hole.

According to the terminal block of the present invention to which the electric wire including the shield material is connected, it is possible to surely hold the shield material in such a manner that one member fixed to the terminal block is folded and caulked with an end of the shield material being sandwiched therein.

Furthermore, the folding portion may have a plurality of the notch holes provided at predetermined intervals.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Figure 1:
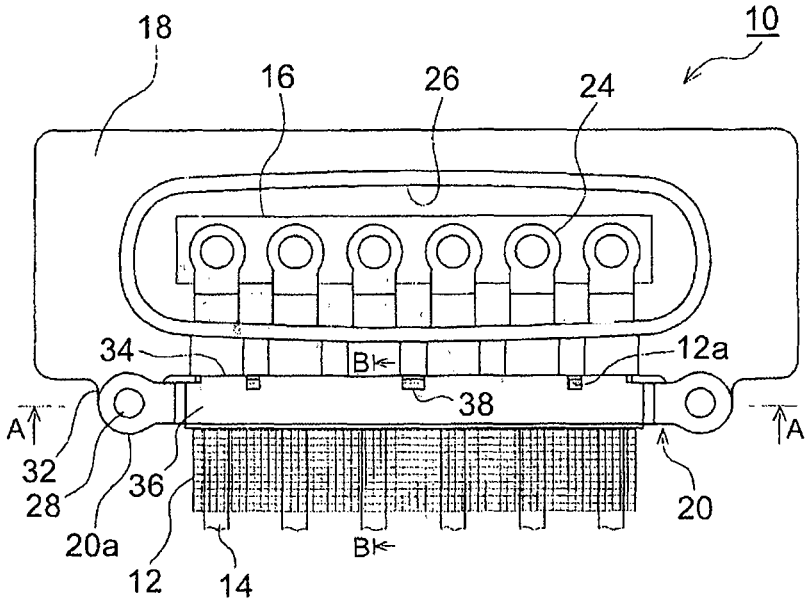
FIG. 1 is a view illustrating a configuration of a terminal block according to the present embodiment.
Figure 2:
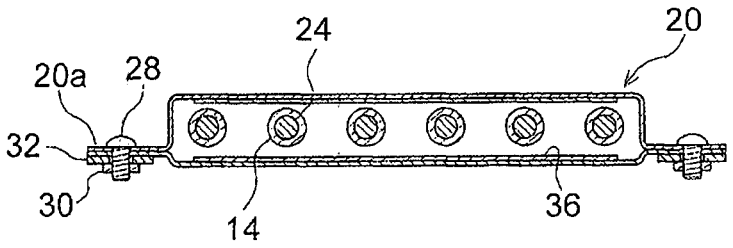
FIG. 2 is a sectional view of the terminal block taken along a line A-A in FIG. 1.
Figure 3:
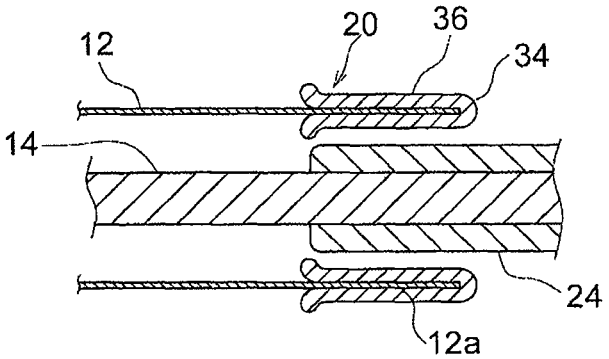
FIG. 3 is a sectional view of the terminal block taken along a line B-B in FIG. 1.

An embodiment of a terminal block according to the present invention will be described below with reference to FIGS. 1 to 3. FIG. 1 is a view illustrating a configuration of the terminal block according to the present embodiment, FIG. 2 is a sectional view of the terminal block taken along a line A-A in FIG. 1, and FIG. 3 is a section view of the terminal block taken along a line B-B in FIG. 1. Note that the shield material is not illustrated in FIG. 2.

The terminal block 10 includes: a terminal 16 to which electric wires 14 covered with a shield material 12 are connected; a housing 18 configured to accommodate the terminal 16 therein; and shield brackets 20 fixed to the housing 18 and configured to hold the shield material 12.

The terminal block 10 is provided in an electric apparatus to be provided in a vehicle. The electric apparatus of the present embodiment is an inverter (not shown), and the electric wires 14 are high-voltage lines configured to connect the inverter to a rotary electric machine (not shown).

The vehicle in the present embodiment is provided with two sets of the inverter and the rotary electric machine, and two sets of U-phase, V-phase, and W-phase electric wires, namely, six electric wires in total are provided as the electric wires 14. However, the present invention is not limited to the case where the number of electric wires 14 is six, and at least one electric wire may be provided as the electric wire 14.

The electric wire 14 is a member configured such that a periphery of a conductor is covered with insulating resin. In the present embodiment, the electric wire 14 has a circular section as illustrated in FIG. 2. Note that the insulating resin terminates inside the shield bracket 20, so that that part of the electric wire 14 from which the insulating resin is removed is connected to a solderless terminal 24. However, the present invention is not limited to this configuration, and the electric wire 14 may have a rectangular section. Further, the electric wire 14 includes the solderless terminal 24 attached, by pressure, to a tip of the electric wire 14, so that the solderless terminal 24 is electrically and mechanically connected to the terminal 16 inside the housing 18. Note that a connection structure between the electric wire 14 and the terminal 16 is not limited to this configuration, and the connection structure may be an insertion connection of a male terminal and a female terminal.

The shield material 12 is constituted by a flexible conductive sheet member. The shield material 12 of the present embodiment is a member formed by braiding, in a sheet shape, fine metal wires made of copper, stainless, aluminum, or the like, and is a so-called braided wire. The shield material 12 covers whole outer circumferences of the six electric wires 14. The shield material 12 is earth-connected via the shield bracket 20, so that the shield material 12 can electromagnetically disconnect the electric wires 14 from their outside. Note that the present embodiment deals with a case where the shield material 12 is configured to cover the outer circumferences of the electric wires 14. However, the present invention is not limited to this configuration. If an electromagnetic disconnect effect is yielded by the shield material 12, the shield material 12 may be configured to cover at least part of the outer circumferences of the electric wires 14. Further, in this example, the six electric wires 14 connected to the terminal block 10 are disposed in one line, but they may be disposed in a plurality of lines. Further, it is preferable that a top face and a bottom face of the shield bracket 20 have a flat shape. Accordingly, it is preferable that a top face and a bottom face of the electric wire 14 have a flat shape in an area where the shield material 12 is connected to the shield bracket 20. However, in the other area, the top face and the bottom face of the electric wire 14 may have a cylindrical shape or may be divided into a plurality of electric wires.

The housing 18 is fixed to a case of the inverter by fastening screw or the like. The housing 18 is made of a conductive member such as copper, stainless, or aluminum, and is earth-connected to a vehicle or the like via an earth conducting path. The housing 18 has an operation hole 26 through which the terminal 16 provided inside the housing 18 is connected to the solderless terminals 24 of the electric wires 14 by use of a tool. Further, the housing 18 includes a fixed portion 32 configured to fix the shield brackets 20 thereto by use of bolts 28 and nuts 30, such that the fixed portion 32 projects in a direction in which the electric wires 14 are exposed from the housing 18.

The shield bracket 20 of the present embodiment includes a folding portion 36 that is folded to hold an end 12*a* of the shield material 12 by sandwiching the end 12*a* therein. The folding portion 36 has notch holes 38 formed by cutting out part of the folding portion 36.

As such, the end 12*a* of the shield material 12 is sandwiched between the folding portion 36 of the shield bracket 20. Hereby, the shield material 12 can be held by only one member. Further, the notch holes 38 are formed in the folding portion 36. This decreases rigidity of the folding portion 36, thereby making it possible to restrain spring back that occurs after bending to shape the folding portion 36. As a result, looseness of caulking to the shield material 12 after the bending is restrained, thereby making it possible to surely hold the shield material.

Figure 4:
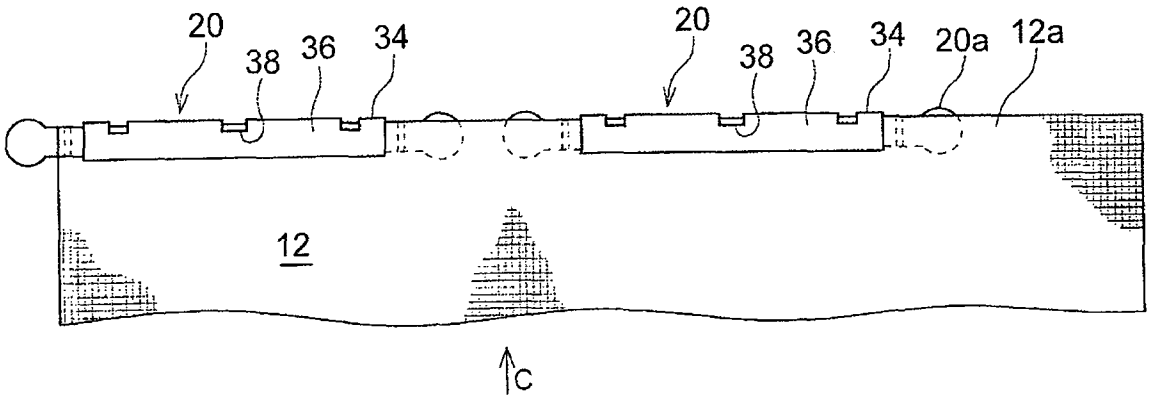
FIG. 4 is a view illustrating a shield material before being attached to an electric wire.
Figure 5:
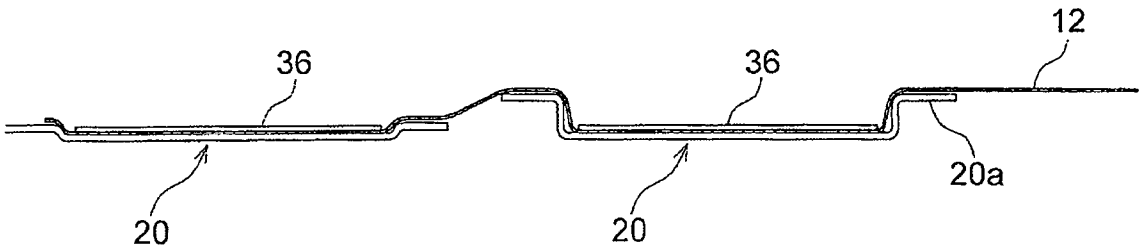
FIG. 5 is a view seen from a direction of C in FIG. 4.
Figure 6:
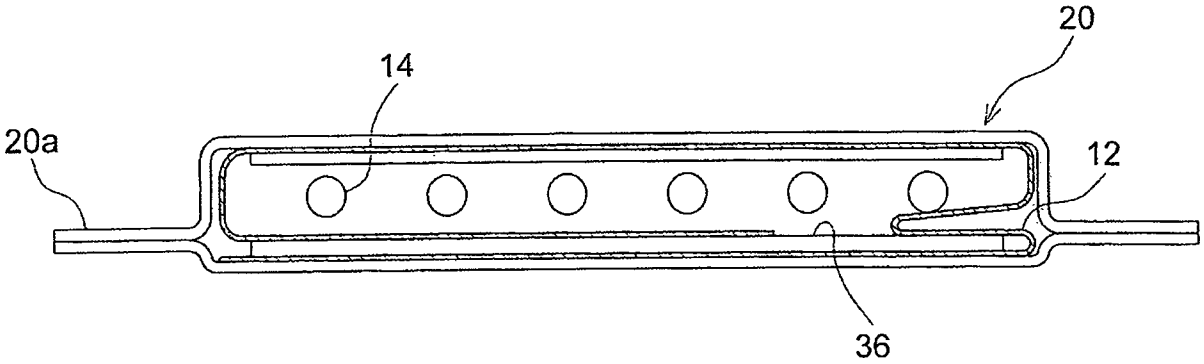
FIG. 6 is a view illustrating a state of the shield material covering an outer circumference of the electric wire.

A holding structure of the shield material 12 is described more specifically, with reference to FIGS. 4 to 6. FIG. 4 is a view illustrating the shield material 12 before being attached to the electric wires 14, and FIG. 5 is a view seen from a direction of C in FIG. 4. The shield material 12 is folded at a central part in the figure in a counterclockwise direction in FIG. 5, so as to have a generally rectangular section. FIG. 6 is a view illustrating a state of the shield material 12 after the shield material 12 is folded so as to cover the outer circumferences of the electric wires 14. In the terminal block 10 of the present embodiment, before the electric wires 14 are covered with the shield material 12, each of the electric wires 14 is connected to the terminal 16 via the solderless terminal 24 in advance.

As illustrated in FIG. 4, the shield material 12 has a sheet shape and has a sufficient width to cover the outer circumferences of the electric wires 14. Two shield brackets 20 are attached to the end 12*a* of the shield material 12 at a predetermined interval.

As illustrated in FIG. 5, the two shield brackets 20 are each formed such that a center thereof is recessed. The two shield brackets 20 are superimposed on each other so as to face each other, so that a tubular space through which the electric wires 14 penetrate is formed in a center therebetween as illustrated in FIG. 6. Further, flanges 20*a* to be fixed to the fixed portion 32 of the housing 18 via the bolts 28 and the nuts 30 are formed at both ends of each of the shield brackets 20 in its width direction.

Further, each of the shield brackets 20 includes the folding portion 36 that is folded along a fold line 34 so as to have a U-shaped section (see FIG. 3). As illustrated in FIG. 4, three notch holes 38 are formed at predetermined intervals on the fold line 34 of the folding portion 36.

The shield material 12 is held such that the end 12*a* thereof is sandwiched by the shield bracket 20. More specifically, the end 12*a* of the shield material 12 is inserted and caulked in a gap of the folding portion 36 thus folded in advance so as to have a U-shaped section, so that the shield material 12 is held by the shield bracket 20. At this time, the notch holes 38 are formed on the fold line 34 of the folding portion 36, so that spring back occurring after bending is restrained as described above. This accordingly makes it possible to surely hold the shield material without loosening the caulking.

Further, as illustrated in FIG. 4, three notch holes 38 are disposed at predetermined intervals along the fold line 34. From each of the notch holes 38, it is possible to visually observe whether or not that end 12*a* of the shield material 12 which is placed inside the folding portion 36 makes contact with the fold line 34. According to such a configuration, it is possible to insert the end 12*a* of the shield material 12 into the gap in the folding portion 36 while checking, through each of the notch holes 38, that the end 12*a* makes contact with the fold line 34 along the width direction. This makes it possible to prevent, beforehand, the end 12*a* from being inserted insufficiently in the folding portion 36. As a result, it is possible to ensure a predetermined contact area between the end 12*a* of the shield material 12 and the folding portion 36, and to prevent the shield material 12 from falling out of the shield bracket 20.

The present embodiment deals with a case where the notch holes 38 are formed at three places of the folding portion 36. However, the present invention is not limited to this configuration. The notch holes 38 may be formed at a plurality of places at predetermined intervals along the fold line 34, provided that the rigidity of the folding portion 36, particularly, the rigidity thereof around the fold line 34 can be decreased so as to restrain spring back in the caulking, and an insertion state of the end 12*a* of the shield material 12 in the folding portion 36 can be observed in the width direction of the shield material 12.

When the shield material 12 is held by each of the two shield brackets 20, the two shield brackets 20 are made opposed and connected to each other so as to cover the outer circumferences of the electric wires 14 as illustrated in FIG. 6. At this time, the shield material 12 is housed in an internal space formed by the two shield brackets 20 such that the shield material 12 covers the outer circumferences of the electric wires 14. Then, the flanges 20*a* of the shield brackets 20 are fastened to the fixed portion 32 of the housing 18 via the bolts 28 and the nuts 30, so that the shield material 12 is fixed to the housing 18 via the shield brackets 20.

According to this configuration, it is possible to fix the shield material 12 to the terminal block 10 after the electric wires 14 are connected to the terminal block 10, and further, it is possible to separate these steps clearly. Hereby, it is possible to easily assemble the electric wires 14 to the terminal block 10.

The present embodiment deals with a case where the shield material 12 is held by each of two shield brackets 20. However, the present invention is not limited to this configuration, and the shield material 12 may be held by only one shield bracket 20. In this case, the shield material 12 is configured so as not to cover the whole outer circumferences of the electric wires 14, but to partially cover the outer circumferences of the electric wires 14 (about half of the outer circumferences thereof in their circumferential directions).

The present invention provides a terminal block to which an electric wire including a shield material is connected and which is able to surely hold the shield material in such a manner that one member fixed to the terminal block is folded and caulked with an end of the shield material being sandwiched therein.

The invention claimed is:

1. A terminal block comprising:

an electric wire;

a shield material configured to cover at least a part of the electric wire;

a terminal to which the electric wire is connected;

a housing configured to accommodate the terminal; and two shield brackets fixed to the housing and facing each other such that a tubular space for the electric wire is defined between the two shield brackets, each of the two shield brackets being configured to hold the shield material, each of the two shield brackets including a folding portion folded along a fold line and having a U-shaped section, wherein the folding portion is configured an end of the shield material by sandwiching the end of the shield material, and wherein the folding portion has a notch hole on the fold line of the folding portion, the notch hole forming a hole in the U-shaped section of the folding portion including the fold line, spaced from the ends of the fold line, the folding portion sandwiching the end of the shield material.

2. The terminal block according to claim 1, wherein the folding portion has a plurality of the notch holes provided at predetermined intervals.

* * * * *